US008794295B2

(12) United States Patent
Rupel et al.

(10) Patent No.: US 8,794,295 B2
(45) Date of Patent: Aug. 5, 2014

(54) CELLULAR SHADE ASSEMBLY AND METHOD FOR CONSTRUCTING SAME

(71) Applicant: Hunter Douglas, Inc., Pearl River, NY (US)

(72) Inventors: John D. Rupel, Pine River, WI (US); Scott R. Cheslock, Pulaski, WI (US)

(73) Assignee: Hunter Doouglas, Inc., Upper Saddle River, NJ (US)

( * ) Notice: Subject to any disclaimer, the term of this patent is extended or adjusted under 35 U.S.C. 154(b) by 0 days.

(21) Appl. No.: 13/913,579

(22) Filed: Jun. 10, 2013

(65) Prior Publication Data

US 2013/0299100 A1 Nov. 14, 2013

Related U.S. Application Data

(62) Division of application No. 12/985,936, filed on Jan. 6, 2011, now Pat. No. 8,459,326.

(51) Int. Cl.
*E06B 3/48* (2006.01)

(52) U.S. Cl.
USPC ..... 160/84.05; 160/84.04

(58) Field of Classification Search
USPC ..... 160/84.05, 84.04, 84.01
See application file for complete search history.

(56) References Cited

U.S. PATENT DOCUMENTS 4,603,072 A * 7/1986 Colson ..... 428/116
4,677,012 A * 6/1987 Anderson ..... 428/116
4,677,013 A * 6/1987 Anderson ..... 428/116
5,205,333 A * 4/1993 Judkins ..... 160/84.02
5,339,882 A * 8/1994 Judkins ..... 160/84.05
5,390,720 A * 2/1995 Colson et al. ..... 160/84.07
5,503,210 A * 4/1996 Colson et al. ..... 160/84.05
5,547,006 A * 8/1996 Auger ..... 160/84.01
5,691,031 A * 11/1997 Swiszcz et al. ..... 428/116
5,701,940 A * 12/1997 Ford et al. ..... 160/84.05
5,746,266 A * 5/1998 Colson et al. ..... 160/84.05
6,068,039 A * 5/2000 Judkins ..... 160/84.05
6,767,615 B1 * 7/2004 Judkins et al. ..... 428/178
6,938,664 B2 * 9/2005 Hsu ..... 160/84.05
6,941,995 B2 * 9/2005 Hsu ..... 160/84.05
6,982,020 B2 * 1/2006 Swiszcz et al. ..... 156/203
7,074,475 B2 * 7/2006 Yu ..... 428/116
7,159,634 B1 * 1/2007 Judkins ..... 160/84.05
7,273,529 B2 * 9/2007 Judkins et al. ..... 156/65
7,513,292 B2 * 4/2009 Auger et al. ..... 160/84.05
7,779,881 B2 * 8/2010 Judkins et al. ..... 156/361
7,984,743 B2 * 7/2011 Rossato ..... 160/84.05

(Continued)

*Primary Examiner* — Katherine Mitchell
*Assistant Examiner* — Johnnie A Shablack
(74) *Attorney, Agent, or Firm* — Dority & Manning, P.A.

(57) ABSTRACT

An expandable and contractable shade assembly includes a plurality of closed cell structures aligned vertically one above another with juncture lines defined between adjacent structures. Each closed cell structure includes a front face and a separate back face. The front face and the back face are offset from one another in relation to a vertical axis. In one embodiment, for instance, the front face of a higher cell is connected to both the front face and back face of a lower cell, while the back face of the higher cell is only connected to the back face of the lower cell. In an alternative embodiment, the front face of a higher cell is only connected to the front face of a lower cell, while the back face of the higher cell is connected to both the front face and the back face of the lower cell. The above configuration can increase strength and dimensional stability of the interconnected cells.

19 Claims, 8 Drawing Sheets

(56) References Cited

U.S. PATENT DOCUMENTS

| | | | | |
|---|---|---|---|---|
| 8,459,326 | B2 * | 6/2013 | Rupel et al. | 160/84.05 |
| 2003/0094247 | A1 * | 5/2003 | Voss et al. | 160/84.05 |
| 2006/0174999 | A1 * | 8/2006 | Rupel et al. | 156/197 |
| 2006/0237146 | A1 * | 10/2006 | Liang | 160/84.05 |
| 2007/0039697 | A1 * | 2/2007 | Sun et al. | 160/84.05 |
| 2010/0300630 | A1 * | 12/2010 | Su | 160/84.05 |
| 2011/0297332 | A1 * | 12/2011 | Rupel | 160/84.05 |

* cited by examiner

CELLULAR SHADE ASSEMBLY AND METHOD FOR CONSTRUCTING SAME

CROSS-REFERENCE TO RELATED APPLICATION

The present application is a Divisional Application of U.S. application Ser. No. 12/985,936, which was filed on Jan. 6, 2011 and is hereby incorporated herein by reference.

BACKGROUND

Cellular shades have become a popular type of window covering in residential and commercial applications. The shades are aesthetically attractive and also provide improved insulation across a window or other type of opening due to their cellular construction. Cellular shades have assumed various forms, including a plurality of longitudinally extending tubes made of a flexible or semi-rigid material. Cellular shades can, for instance, be mounted at the top of a door or window for extending across an architectural opening. When the shade is in an expanded state, the tubes cover the opening. The shade can be retracted or drawn into a contracted state wherein the tubes collapse into a stack. When viewed from the front (i.e., interior of a room) this stack may have an appearance similar to stacked slats of a Venetian blind. Typically, the width of the stack is half of the overall perimeter of the cell and projects from the glass side to the room side since the cords are normally disposed through the connecting point between each cell.

In the past, individual cells in a cellular shade have been constructed using various techniques and methods. The construction of cellular shades, for instance, is described in U.S. Pat. Nos. 6,767,615; 4,861,404; 4,677,012; 5,701,940; 5,691,031; 4,603,072; 4,732,630; 4,388,354; 5,228,936; 5,339,882; 6,068,039; 6,033,504; and 5,753,338, which are all incorporated herein by reference.

For example, in one embodiment, a cellular shade is produced from two sheets of material which are pleated and then glued at the apex of the folds to form the cells. In an alternative embodiment, cellular shades can be produced by joining together multiple flat sheets of material along alternating glue lines between each flat sheet. In still another embodiment, a cellular shade can be produced by attaching a series of slats between two spaced apart sheets of material.

In another embodiment, a cellular shade can be produced in which each cell has a front section and a rear section. The sections are configured to form a V-shape or a C-shape and are positioned so that the free edges are opposite one another. A section of swirled strands is connected between one free edge of the front section and one free edge of the rear section. If desired, a second section of swirled strands can be connected between the second edge of the front section and the second edge of the rear section to form a closed cell. The cells are connected to one another by a pair of glue beads adjacent or on top of the section of swirled strands.

The present disclosure is directed to further improvements in cellular shades. More particularly, the present disclosure is directed to an improved cell structure and method for constructing a cellular shade.

SUMMARY

The present disclosure is directed to a cellular shade comprised of a plurality of closed cell structures. As will be described in greater detail below, the closed cell structures are made from separate pieces of material allowing for the cell structures to include a face fabric that is different from a back fabric if desired. In accordance with the present disclosure, the front face and the back face are positioned in an offset relationship with respect to a vertical axis that intersects the cells when the cells are in an open position. Positioning the front face and back face in an offset relationship allows for the production of a cellular shade having improved strength characteristics. In particular, the construction provides good attachment strength between adjacent cell structures.

In one embodiment, for instance, the present disclosure is directed to a cellular shade comprising a plurality of sequential and interconnected closed cell structures extending in a longitudinal direction. The cell structures have a collapsed position when the shade is retracted and have an open position when the shade is extended. The cell structures include a front face and a separate back face. The cell structures are constructed such that the front face is offset from the back face.

The front face of a higher cell structure, for instance, can be attached to both the front face and the back face of the lower cell structure. The back face of the higher cell structure, on the other hand, can be attached to only the back face of the lower cell structure in a manner that causes the cell structures to be symmetrical about a plane that intersects the cell structure mid-height when the cell is in the open position. In other words, even though the front face and the back face are in an offset relationship, cell structures can be configured such that the offset nature of the materials is not noticeable when viewing the shade. In addition, the cells can be produced so as to have a substantially symmetrical look.

In one embodiment, the front face can include a first segment separated from a second segment by a first fold line. The back face can include a corresponding first segment separated from a corresponding second segment by a second fold line. The front face and back face are offset such that the first segment of the front face has a length less than the length of the second segment of the front face and the first segment of the back face can have a length greater than the length of the second segment of the back face.

In one embodiment, the first segment of the front face is above the second segment of the front face in the longitudinal direction and the first segment of the back face is above the second segment of the back face in the longitudinal direction. Alternatively, the cell structures can be made such that the second segment of the front face is above the first segment of the front face in the longitudinal direction and the second segment of the back face is above the first segment of the back face in the longitudinal direction.

The cellular shade can further include a lift system that is configured for vertically drawing the closed cell structures from a fully expanded configuration into a fully retracted configuration. The lift system, for instance, may include a plurality of lift cords that are connected to the closed cell structures. The cellular shade can further include a head rail assembly for mounting the shade into an architectural opening. The head rail assembly may also be in operative association with the lift system for retracting and extending the cellular shade.

In one embodiment, the back face of each cellular structure comprises two separate pieces of material joined together along the second fold line. A tab may be formed where the two pieces of material are joined together. The tab may extend transversely from the cellular structures about mid-height and can be attached to the vertical cords of the lift system. In the above arrangement, when the cellular shade is in a fully retracted configuration, the closed cell structures collapse into a flat profile. More particularly, the plurality of closed cell structures can hang from the lift cords in a vertical and adjacently disposed orientation whereby upper edges of the collapsed closed cell structures are adjacent and oriented in an upward vertical direction and bottom edges of the collapsed cell structures are adjacent and oriented in a downward vertical direction. The upper edges, for instance, can be defined by the first fold lines while the bottom edges can be defined by the second fold lines.

In an alternative embodiment, the lift cords may extend through the center of the cellular structures. In this arrangement, when the cellular shade is in the fully retracted configuration, the cellular structures collapse and form a horizontally stacked arrangement.

As described above, one of the advantages of the present disclosure is the ability to produce closed cell structures in which the face fabric is different from the back fabric. In one embodiment, for instance, the color of the face fabric may be different than the color of the back fabric. In another embodiment, the face fabric may have a different opacity and/or transmittance than the back fabric. For example, the back fabric can be made from a material that allows substantial amounts of light to transmit through the material, while the face fabric can be made from a material that allows less light to pass through the material in comparison to the back fabric or may substantially block light from passing through the material. Adjusting the opacity and/or the transmittance of the face fabric and the back fabric can produce a shade product that illuminates a room in a desired way.

In one particular embodiment, for instance, the back face of the cellular structures may have a transmittance at a wavelength of 500 nanometers that is at least 50% greater than the transmittance of the front face at 500 nanometers. For instance, the back face can have a light transmittance at a wavelength of 500 nanometers of at least 40%. In one particular embodiment, for instance, the back face can be made from a shear material that allows light to pass through the material and illuminate the front face when the shade is exposed to sunlight.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
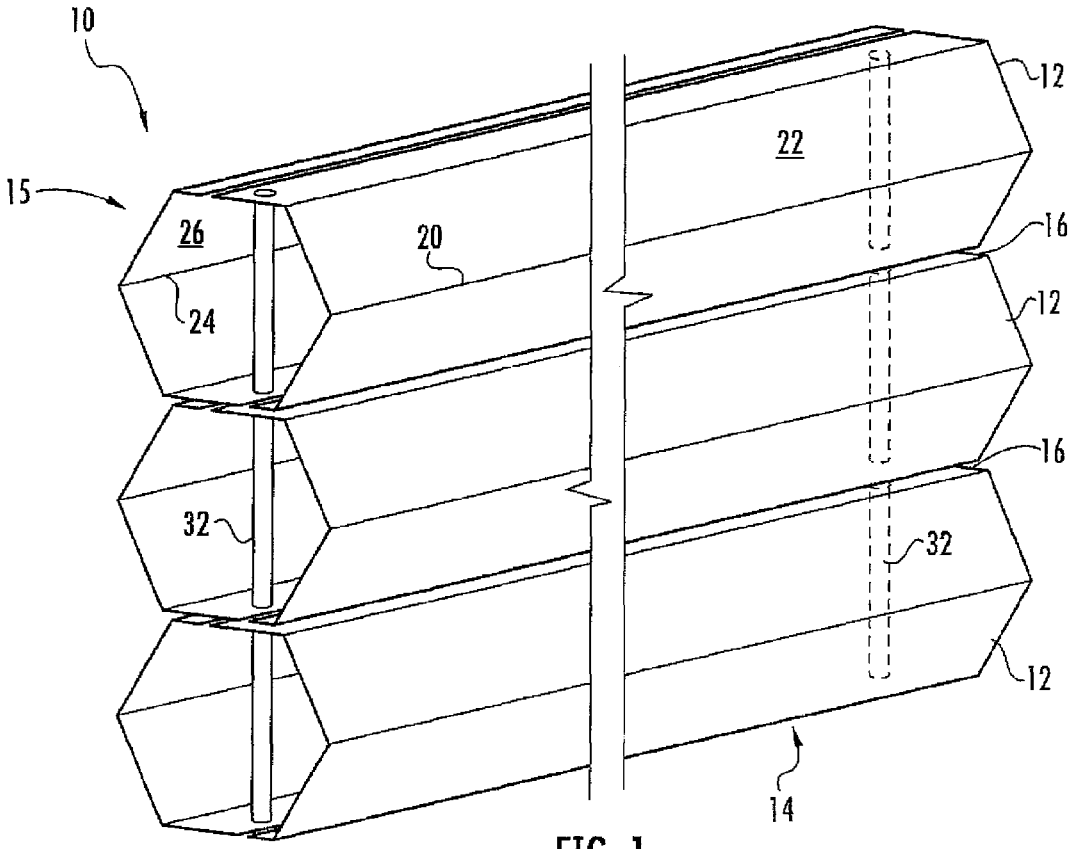
FIG. 1 is a partial perspective view of one embodiment of a cellular shade assembly made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to cellular shade assemblies that can be mounted in an architectural opening, such as a window or door, for blocking light, providing privacy, increasing the aesthetic appeal of a room and/or allowing a desired amount of light into a room. The present disclosure is particularly directed to different methods for constructing closed cell structures that are used to produce cellular shade assemblies.

The closed cell structures of the present disclosure offer various advantages and benefits. For example, the closed cell structures are made from multiple pieces of fabric that allow for different fabrics to be combined together in producing the cell structures. The different fabrics can be combined for increasing the overall aesthetic appeal of the product and/or for adjusting the amount of light that passes through the shade assembly.

In addition, the cell structures of the present disclosure have excellent strength properties when sequentially connected together increasing the overall strength of the product.

Referring to FIGS. 1 through 4, for instance, one embodiment of an expandable and contractable shade assembly 10 made in accordance with the present disclosure is shown. In FIG. 1, a portion of the shade assembly is shown, which can be mounted within a window similar to the embodiment illustrated in FIG. 6. It should be readily appreciated, however, that the shade assembly 10 is not limited in its particular use as a window or door shade, and may be used in any application as a covering, partition, shade, or the like in any type of architectural opening in a building or structure.

As shown in FIGS. 1 through 4, the shade assembly 10 includes a plurality of closed cell structures 12 that are disposed longitudinally along a width dimension of the shade assembly so as to extend across a window or other opening. The closed cell structures 12 are aligned vertically one above another with juncture lines 16 defined between adjacent cell structures 12. The shade assembly 10 generally includes a front 14 that is intended to face the interior of a room or building and a back 15 that is intended to face a window or the outside environment.

As depicted in the various figures, each of the cell structures 12 is closed in that the structure is defined by a continuous, unbroken circumferential wall. The cell structures 12 are formed from a material or fabric that may be flexible or semi-rigid. As will be described in greater detail below, the cell structures 12 can be made from a single type of material or fabric or can be constructed from different types of materials or fabrics depending upon the particular application. A flexible material is capable of being folded or flexed, and includes such materials as woven, knitted, or non-woven fabrics, vinyl or film sheets, cords of natural or synthetic fibers, monofilaments, and the like. A semi-rigid material is somewhat stiffer, but is still flexible or foldable to some degree. Examples of such materials include resin reinforced fabrics, polyvinyl chloride, and so forth. It should be readily appreciated that the present disclosure is not limited to the type of material used to form the cell structures.

Figure 2:
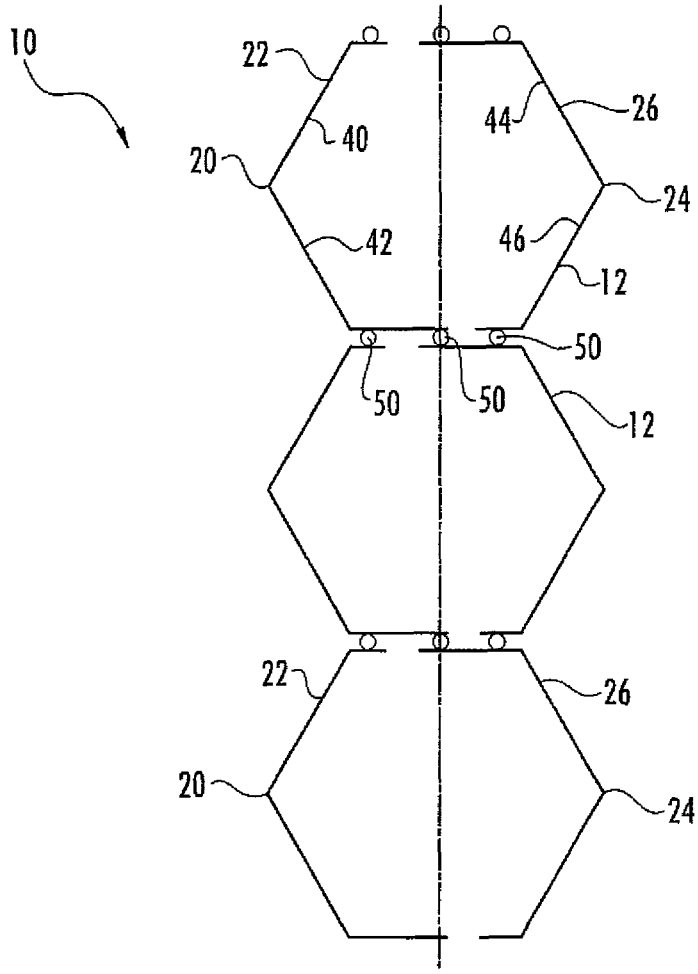
FIG. 2 is an exploded side view of the cellular structures illustrated in FIG. 1.
Figure 3:
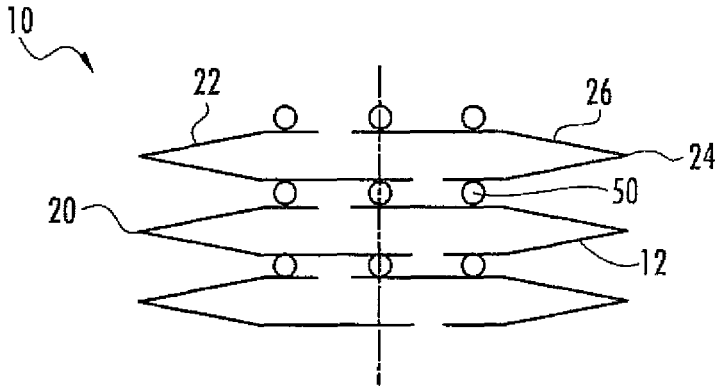
FIG. 3 is another side view of the cellular structures illustrated in FIG. 1 shown in a contracted position.
Figure 6:
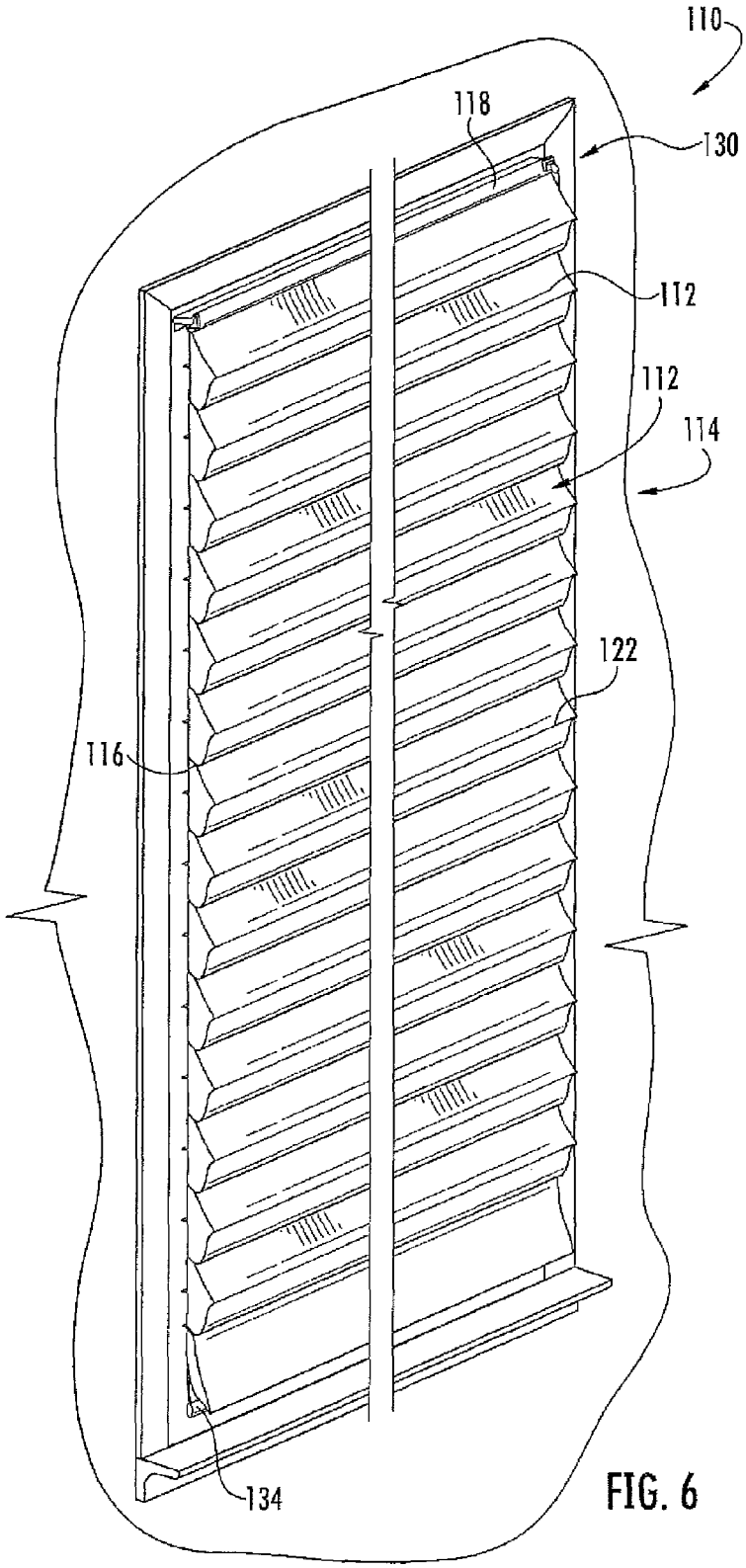
FIG. 6 is a perspective view of another embodiment of a cellular shade assembly made in accordance with the present disclosure.

Similar to the embodiment illustrated in FIG. 6, the shade assembly 10 shown in FIG. 1 can include a head rail that is adapted to be mounted to the frame structure of a window, door or other type of opening. The head rail may include an extruded longitudinally extending component that includes any number of chambers, channels or other features necessary for incorporating a lift system, cords, pulleys and the like, for raising and lowering the shade assembly 10 between a fully expanded configuration as illustrated in FIGS. 1 and 2 and a fully contracted configuration as illustrated in FIG. 3. In the embodiments illustrated in FIGS. 1 through 4, the closed cell structures 12 generally have a hexagon-like shape. As shown in FIG. 2, for instance, each cell structure 12 includes a first fold line 20 located along a front face 22 and an opposing second fold line 24 located along a back face 26. The fold lines 20 and 24 result in a unique three-dimensional expansion of the front face 22 and the back face 26 resulting in the hexagon-like shape. In an alternative embodiment, however, the cell structures 12 may not include the fold lines 20 and 24. In this embodiment, the front face 22 and the back face 26 will have an essentially flat, vertical profile.

As shown in FIG. 3, the first fold line 20 along the front face 22 and the second fold line 24 along the back face 26 cause the cell structures 12 to close when the shade assembly is contracted such that the front face 22 collapses against itself along the fold line 20. Similarly, the back face 26 also collapses upon itself along the second fold line 24.

In order to adjust the shade assembly between an extended position and a collapsed position, the shade assembly can include a lift system. Various cord-type lift systems are well known in the art, and any one of these types of systems may be configured or utilized for use with the shade assembly 10. As shown particularly in FIG. 1, the lift system includes a plurality of lift cords 32. The lift cords 32 are disposed in a vertical line of action intersecting each closed cell structure 12. In particular, the lift cords 32 extend through the closed cell structures 12 from the top of each cell structure to the bottom of each cell structure and generally lie in a plane that intersects the closed cell structures between a front half and a back half.

The lift cords 32 may vary in number depending upon the width of the shade assembly 10. For example, at least two lift cords can be spaced over the width of the shade assembly, such as from about two lift cords to about six lift cords.

To aid in raising and lowering the shade assembly 10, the assembly may include a ballast member positioned below a bottommost cell structure 12. The ballast member may comprise a bar or other weighted member that extends generally across the width of the shade assembly. The lift cords 32 can be attached to the ballast member when present.

In the embodiment illustrated in FIGS. 1 through 4, the cell structures 12 collapse into a horizontal stack when the assembly is in a fully contracted configuration as shown in FIG. 3. In particular, the stack of cell structures 12 are horizontally oriented in that the first fold lines 20 and the second fold lines 24 extend horizontally between the front 14 and the back 15 of the shade assembly 10.

Referring now to FIG. 2, the manner in which the closed cell structures 12 are constructed is shown in greater detail. As illustrated, the first fold line 20 divides the front face 22 into a first segment 40 and a second segment 42. Similarly, the second fold line 24 divides the back face 26 into a corresponding first segment 44 and a second segment 46. In accordance with the present disclosure, due to the manner in which adjacent cells are attached together, the first segment 40 of the front face 22 is shorter in length than the second segment 42 of the front face 22. The back face 26, on the other hand, is in an offset relationship with the front face 22. In this manner, the length of the segments 44 and 46 of the back face 26 are reversed with respect to the first and second segments 40 and 42 of the front face 22. Specifically, the first segment 44 of the back face 26 has a length greater than the length of the second segment 46 of the back face 26.

As shown in FIG. 2, adjacent cell structures 12 are attached to each other along attachment points 50. Each attachment point 50 may comprise, for instance, a bead of adhesive or any other suitable attachment structure, such as stitches. In an alternative embodiment, the cell structures may be attached to each other along a single attachment point that extends the entire width of the three attachment points illustrated. As shown, the front face 22 of a cell structure is offset from the back face 26 in a manner such that the front face of a higher cell structure is attached to both the front face and the back face of a lower cell structure, while the back face of the higher cell structure is attached to only the back face of the lower adjacent cell structure. This attachment configuration can provide various advantages and benefits, including providing a plurality of sequential interconnected closed cell structures that have excellent strength properties where the cells are connected.

The attachment points 50 as shown in FIG. 2 not only connect the cellular structures together, but also assist in providing the overall shape of the cells. The attachment points, for instance, assist in creating the hexagon-like shape of the cell structures without having to create further fold lines in the front face 22 or the back face 26. In this regard, the shape of the cell structures 12 can be modified by increasing or decreasing the width of the attachment points between adjacent cell structures.

In the embodiment illustrated in FIG. 2, the first segment 40 of the front face 22 generally has a shorter length than the second segment 42, while the first segment 44 generally has a longer length than the second segment 46 of the back face 26. It should be understood, however, that the arrangement may be reversed such that the first segment 40 is longer than the second segment 42 of the front face 22 and the first segment 44 is shorter than the second segment 46 of the back face 26.

Referring to FIG. 1, the offset relationship of the front face 22 and the back face 26 can also have an impact on the manner in which the lift cords 32 intersect the cell structures 12. For example, as shown in FIG. 1, the lift cords 32 only intersect the front face 22 at the top of each cell structure and only intersect the back face 26 at the bottom of each cell structure. It is believed that the manner in which the lift cords intersect the cells provides greater dimensional stability, especially in the longitudinal direction.

Although the front face 22 and the back face 26 are in an offset relationship with respect to each other, the cell structures 12 can be constructed to be substantially symmetrical between the bottom half of the cell and the top half of the cell. For instance, as shown in FIG. 4, the top half of the cell structure 12 is symmetrical to the bottom half of the cell structure when viewed about a plane 52 that intersects the cell structure mid-height when the cell structure is in the open position.

Figure 4:
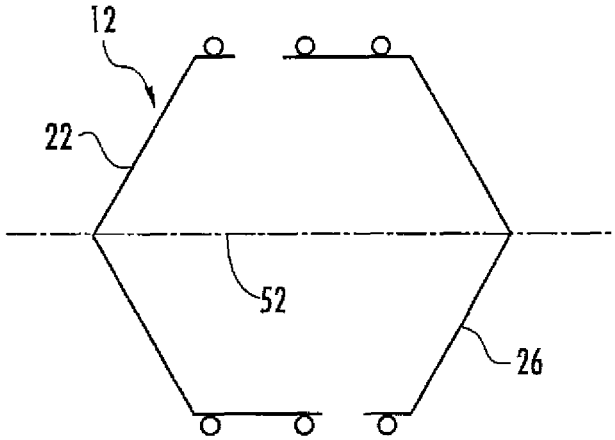
FIG. 4 is a cross-sectional view of one embodiment of a closed cell structure made in accordance with the present disclosure.

As shown in FIG. 4, the front face 22 and the back face 26 of each closed cell structure is made from a separate piece of material. In one embodiment, the front face 22 and the back face 26 can be made from the same type of material or fabric. In other embodiments, however, the front face may be made from a different material than the back face. Different materials or fabrics, for instance, can be combined together to produce a shade assembly having desired characteristics and properties.

In one embodiment, for example, the front face 22 can be made from a material that does not permit significant amounts of light to pass through the material, while the back face 26 can be made from a material that allows much larger quantities of light to pass through the material. In this manner, the front face 22 may appear to illuminate when the shade assembly is in an extended position and light, such as sunlight, is striking the shade from the back side. In the above embodiment, for example, the back face 26 may be made from a fabric having a relatively open weave, such as a shear material made from monofilaments or may comprise a film. The front face 22, on the other hand, may comprise a woven fabric, a knitted fabric, or a non-woven fabric such as a hydroentangled web.

When combining together different fabrics as described above, in one embodiment, the back face can have a light transmittance at a wavelength of 500 nanometers that is at least 50% greater than a transmittance of the front face at 500 nanometers. For instance, the back face can have a light transmittance at a wavelength of 500 nanometers of at least about 20%, such as at least about 30%, such as at least about 40%, such as at least about 50%, such as at least about 60%, such as even greater than about 70%. Light transmittance of a fabric can be tested using a spectrophotometer, such as a JASCO V-570 UV/VIS/NIR spectrophotometer. One procedure for measuring the percent transmittance of a material is described, for instance, in U.S. Pat. No. 7,481,076, which is incorporated herein by reference.

In the embodiment described above, the back face is designed to allow greater amounts of light to pass through the material than the front face. In an alternative embodiment, however, the arrangement may be reversed.

Another way to compare the front face material with the back face material is to measure opacity. Opacity can be measured using a Hunter Color Difference Meter and can range from 0 to 100%. In one embodiment, the opacity of the back face material may be at least 20% less, such as at least 30% less, such as at least 40% less, such as at least 50% less, such as at least 60% less than the front face material or vice versus.

Referring now to FIGS. 5 through 10, another embodiment of a cellular shade assembly 110 generally made in accordance with the present disclosure is shown. The individual closed cell structure 112 that makes up the shade assembly 110 is particularly shown in FIG. 5. Similar to the embodiment illustrated in FIG. 4, the closed cell structure 112 includes a front face 122 that is separate from a back face 126. The front face 122 defines a first fold line 120 that separates the front face into a first segment 140 and a second segment 142. The back face 126 defines a second fold line 124 that separates the back face into a first segment 144 and a second segment 146. Similar to the embodiment illustrated in FIG. 4, the front face 122 is offset from the back face 126. In the embodiment illustrated, for example, the front face 122 of a higher cell is attached to the front face and the back face of a lower cell, while the back face 126 of a higher cell is only attached to the back face of a lower cell along attachment points 150. As described above, this arrangement may be reversed in an alternative embodiment in which the front face of a higher cell is only attached to the front face of a lower cell, while the back face of a higher cell may be attached to both the front face and back face of a lower cell.

Figure 5:
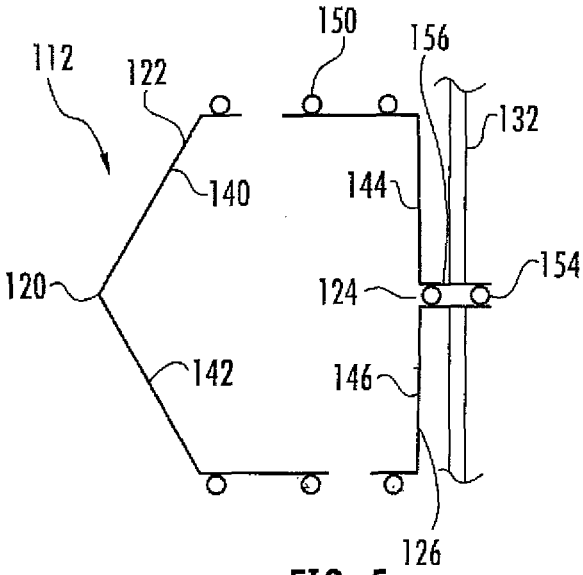
FIG. 5 is an exploded side view of another embodiment of a closed cell structure made in accordance with the present disclosure.

In the embodiment illustrated in FIG. 5, the back face 126 is separated into two separate pieces of material. In particular, the first segment 144 is made from a separate piece of material than the second segment 146. The first segment 144 is attached to the second segment 146 at bond points 154 forming a tab 156. It should be understood that the tab 156 can also be formed along the back face 126 without having to use two separate pieces of material. As also shown, the back face 126 is shorter in length than the front face 122 causing the back face to have a substantially vertical profile when the closed cell structures 112 are in an open and expanded position.

Similar to the embodiment illustrated in FIG. 4, the cell structure 112 illustrated in FIG. 5 can also be made from different materials. In particular, the front face 122 can be made from a different material than the back face 126 as described above. In addition, the first segment 144 of the back face 126 can also be made from a different material than the second segment 146 of the back face 126.

In the embodiment illustrated in FIG. 5, the front face 122 defines a first fold line 120. In an alternative embodiment, however, the front face 122 may not include a fold line. Instead, the front face may billow outwardly from the back face and may have a drooping aspect as well. The drooping and/or billowing profile may be desired in some applications for providing a unique and aesthetically pleasing appearance.

As described above, in yet another embodiment, the front face 122 may have approximately the same length as the back face 126 such that both faces of the cell have a substantially vertical profile.

Figure 7:
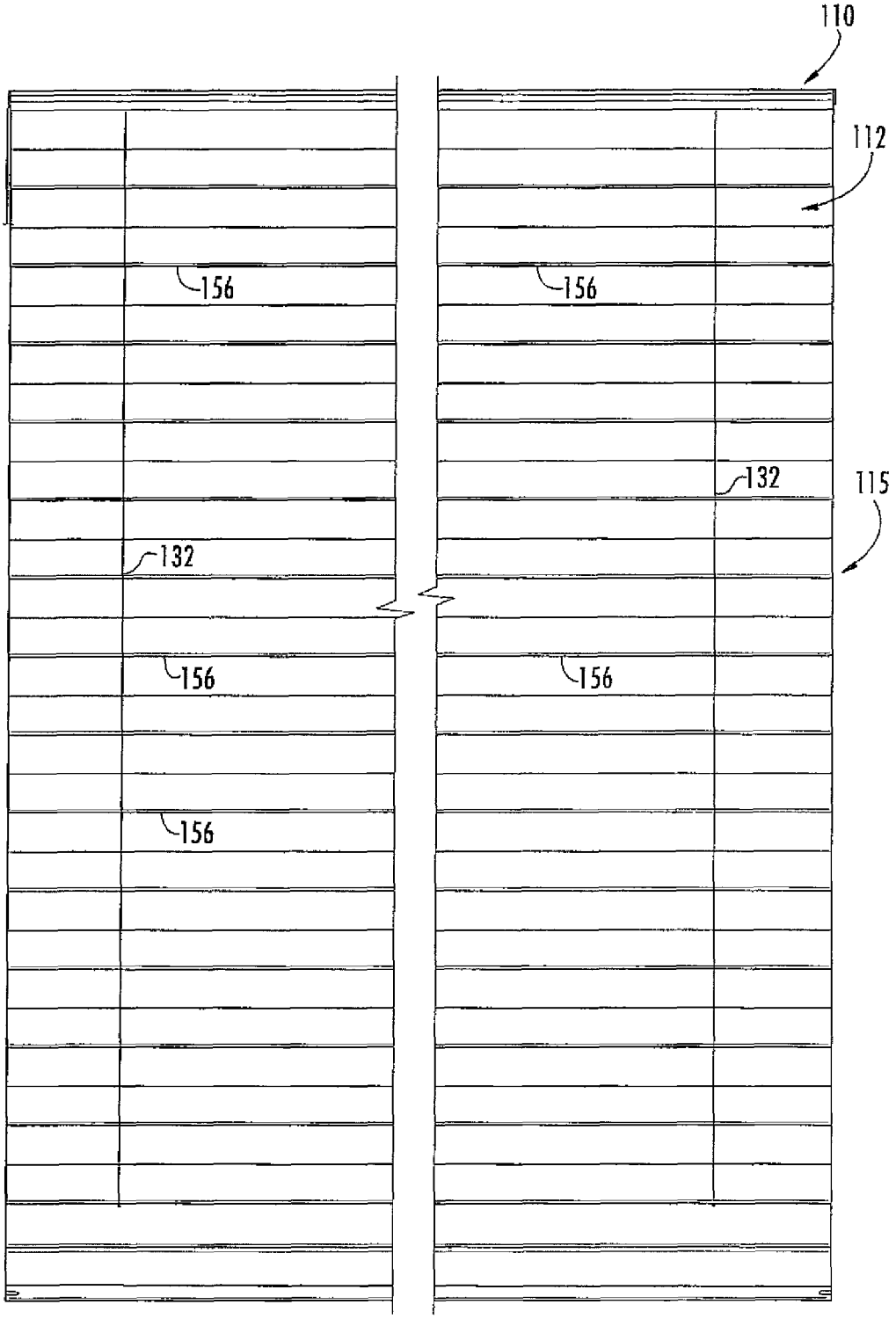
FIG. 7 is a back plan view of the cellular shade assembly illustrated in FIG. 6.

The entire shade assembly 110 is more particularly shown in FIGS. 6 and 7. FIG. 6 illustrates a front 114 of the shade assembly, while FIG. 7 illustrates a back 115 of the shade assembly. As shown, the shade assembly can include a head rail 118 towards the top of the assembly and a ballast member 134 located at the bottom of the assembly. When in the expanded configuration as shown in FIG. 6, the closed cell structures 112 are in a sequential and interconnected relationship, separated by juncture lines 116.

The shade assembly 110 further includes a lift system 130 that includes a plurality of lift cords 132. As shown in FIG. 7, in this embodiment, the lift cords 132 are disposed in a vertical line of action that is rearward of the back faces 126 of the closed cell structures 112. Thus, the lift cords 132 do not extend through the closed cell structures and do not break or penetrate through the closed circumferential wall of the cells. As described above, the number of lift cords 132 can vary depending upon the particular application. In the embodiment illustrated, the shade assembly 110 includes two parallel lift cords 132 located along the back 115 of the shade assembly 110.

More particularly, the lift cords 132 are attached to the tabs 156 of the back faces 126 of the closed cell structures 112. As shown in FIG. 5, the tabs 156 extend outwardly generally at about the mid-height of each closed cell structure as defined between adjacent juncture lines 116.

The lift cords 132 may engage with the back faces 126 of the individual cell structures 112 by various means. For instance, the lift cords 132 may pass through a hole or grommet in each of the tabs 132.

One advantage to the embodiment illustrated in FIGS. 5 through 10 is that the shade assembly 110 assumes a vertical configuration when fully contracted. As shown particularly in FIGS. 8 through 10, for instance, the plurality of closed cell structures 112 are drawn together and hang essentially vertically from the lift cords 132 in the contracted configuration of the shade assembly. The collapsed cell structures 112 have upper edges defined by the second fold lines 124 that are generally defined by the attachment locations with the lift cords. These upper edges are adjacent and oriented in an upward vertical direction. Similarly, the bottom edges defined by the first fold lines 120 of the collapsed cell structures 112 are adjacent and oriented in a downward vertical direction. In this manner, when viewed from the front of the shade assembly, the gathered and collapsed cell structures 112 appear to hang vertically from out of the head rail assembly 118 in a unique and aesthetically pleasing configuration. In addition, the depth of the vertically oriented and collapsed cell structures is significantly reduced as compared to the horizontal configuration illustrated in FIG. 3. Thus, the closed cell structures 12 can be constructed with much larger dimensions in the embodiment illustrated in FIGS. 8 through 10 without having to enlarge or increase the depth of the architectural opening.

Figure 8:
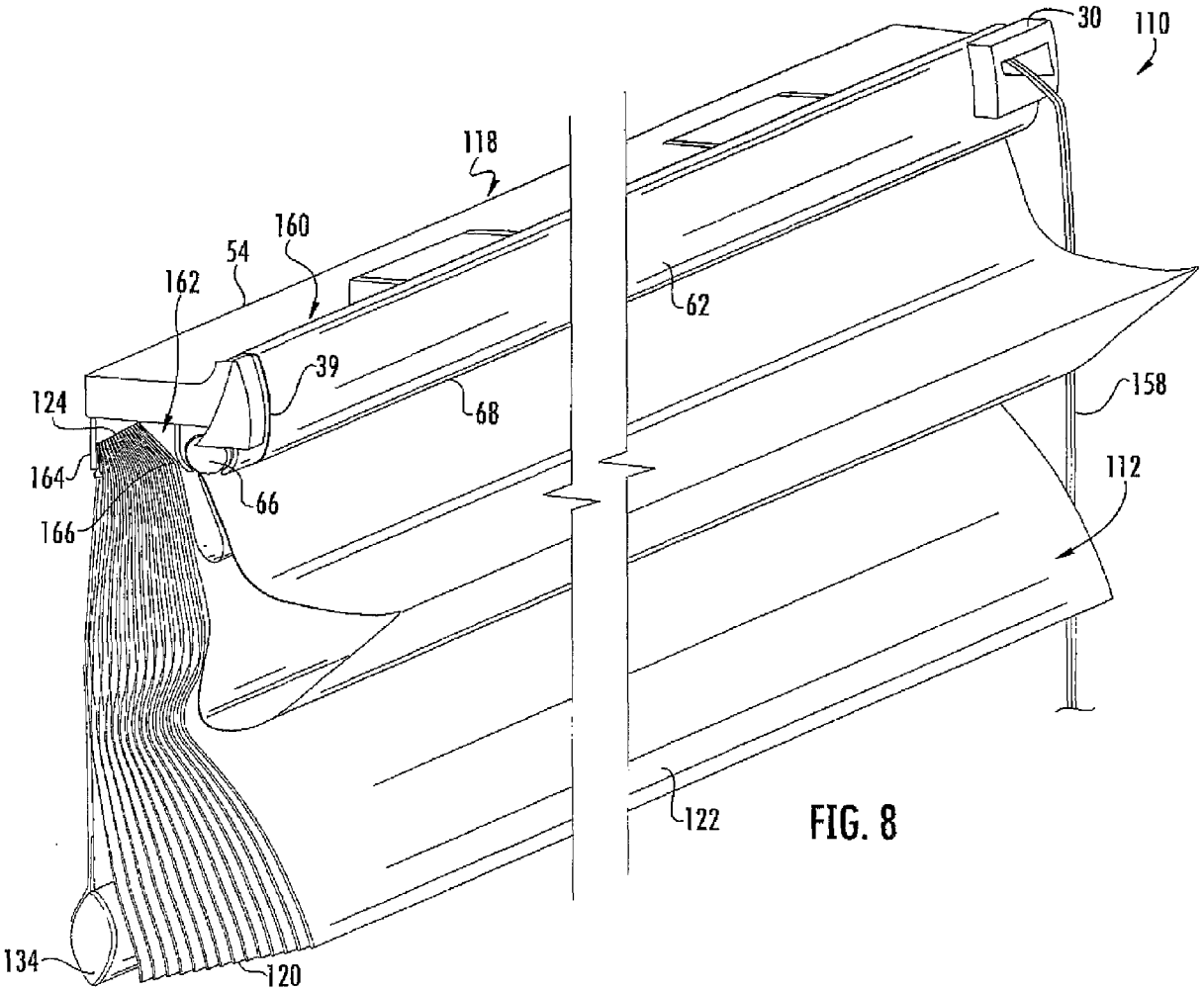
FIG. 8 is a perspective view of the cellular shade assembly illustrated in FIG. 6 shown in a contracted position.
Figure 9:
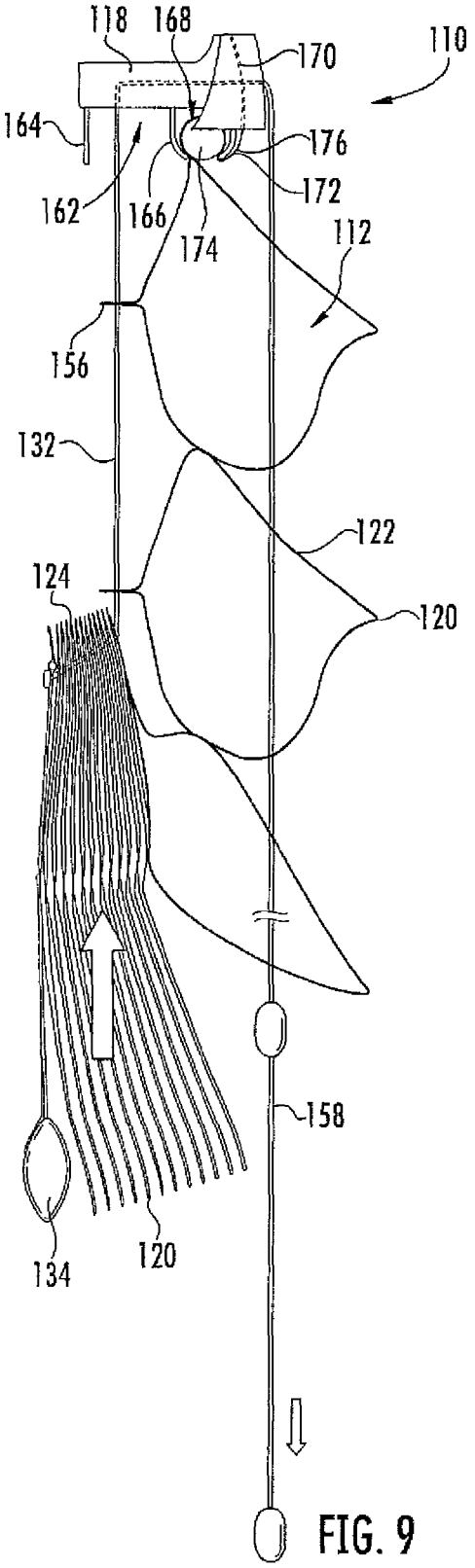
FIG. 9 is a side view of the cellular shade assembly illustrated in FIG. 6 shown in a partially contracted position.
Figure 10:
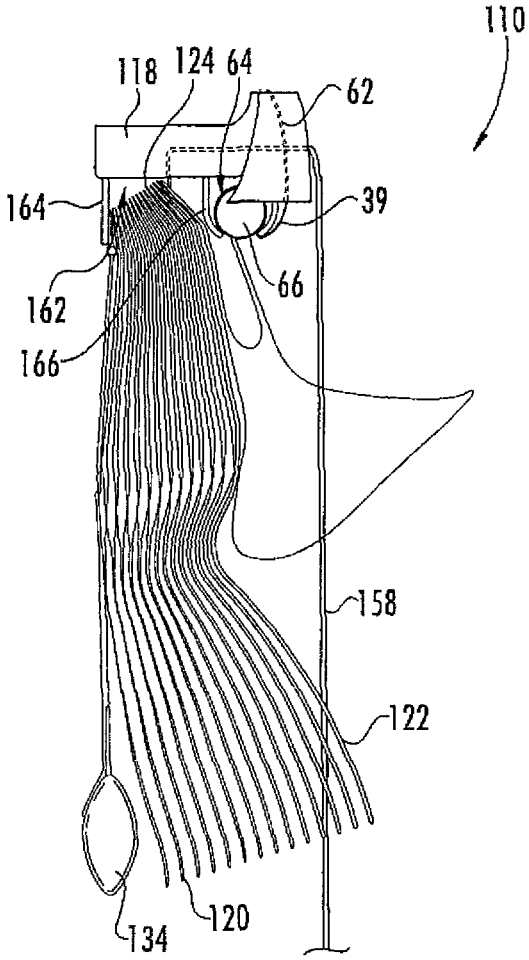
FIG. 10 is a side view of the cellular shade assembly illustrated in FIG. 8.

As shown in FIGS. 8 through 10, the lift cords 132 are actuated by pull cords 158. The pull cords 158 may be extensions of the lift cords 132 and can be presented at a front side of the shade assembly 110 for a user's convenience in operating the shade assembly. It should be readily appreciated that any manner of pulley, bearing, guide, and the like may be incorporated into the head rail assembly 118 for this purpose.

In the embodiment illustrated in FIGS. 8 through 10, the head rail assembly 118 includes an extruded component defining a longitudinally extending tray 160 in which the lift cords 132 are disposed, as well as any other necessary components of the lifting or control system. The head rail assembly 118 further defines a longitudinally extending internal channel 162 that is defined between a back guide member 164 and a front guide member 166. This internal channel defines a space in which the upper edges of the collapsed cell structures 112 are drawn and held in an adjacent and vertically oriented configuration in the fully contracted state of the shade assembly 110. It should be appreciated that the internal channel 162 may be defined by any manner of structure that is formed integrally or attached to the head rail assembly 118.

Still referring to the head rail assembly 118, as shown in FIGS. 8 through 10, a separate retaining channel 168 may also be defined in the head rail. In the illustrated embodiment, this retaining channel 168 is defined between the front guide member 166 and a front panel 170. The front panel 170 may also define the front face of the head rail assembly 118 that is visible from the front of the shade assembly 110 and, in this regard, may have any desired length or aesthetically pleasing configuration. The front panel 170 may include a curved bottom lip 172 that is oriented towards a curved lip of the front guide member 166. A retaining bar, rod or other member 174 is disposed longitudinally within the retaining channel 168 and serves as the anchor attachment location of the cell structures 112 to the head rail assembly 118. Referring to FIG. 9, the uppermost cell structure 112 includes an extension segment 176 that is adhered or otherwise attached to the retaining bar 174. Thus, in the construction of the shade assembly 110, it is only necessary to attach the uppermost cell structure 112 to the retaining bar 174 and then slide the retaining bar into the channel 168 from an end of the head rail. In one embodiment, the material that defines the front face 122 of the uppermost cell structure 112 also defines the head rail extension segment 176. This material may also wrap around the bar 174 and extend onto the front face of the panel 170. In this manner, the material that defines the cell structures 112 may also act as a decorative covering to the front panel 170, thus eliminating the requirement for a separate valance or similar device.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A cellular shade comprising:

a plurality of sequential and interconnected closed cell structures extending in a longitudinal direction, the cell structures having a collapsed position when the shade is retracted and having an open position when the shade is extended, the plurality of closed cell structures including a higher cell structure and an adjacent lower cell structure, wherein the higher and lower cell structures each include a front face and a separate back face, each front face including a first segment separated from a second segment by a first fold line, and each back face including a corresponding first segment separated from a corresponding second segment by a second fold line, wherein the first segments of the front faces each have a. length less than the length of the second segments of the front faces and wherein the first segments of the back faces each have a length greater than the length of the second segments of the back faces, and wherein the front face of the higher cell structure is attached to the front face of the lower cell structure and the back face of the higher cell structure is attached to the back face of the lower cell structure;

wherein the second segment of the front face of the higher cell structure overlaps with both the front face and the back face of the lower cell structure, and wherein the second segment of the back face of the higher cell structure overlaps with only the back face of the lower cell structure; and a lift system configured for vertically drawing said cell structures from an expanded configuration into a contracted configuration.

2. A cellular shade as defined in claim 1, further comprising a head rail, the lift system being in operative association with the head rail for vertically drawing the closed cell structures from a fully expanded configuration to a fully retracted configuration.

3. A cellular shade as defined in claim 1, wherein for both the higher cell structure and the lower cell structure the first segments of the front faces are above the second segments of the front faces in the longitudinal direction and the first segments of the back faces are above the second segments of the back faces in the longitudinal direction.

4. A cellular shade as defined in claim 3, wherein the front face of the higher cell structure is attached to both the front face and the back face of the lower cell structure and the back face of the higher cell structure is attached to the back face of the lower cell structure.

5. A cellular shade as defined in claim 1, wherein the first and second segments of the back faces comprise two separate pieces of material joined together along the second fold line.

6. A cellular shade as defined in claim 5, wherein a tab is formed where the two pieces of material are joined together.

7. A cellular shade as defined in claim 1, wherein the cellular shade includes a plurality of juncture lines that attach adjacent cell structures together, the juncture lines having a width extending from a front to a back of the cell structures and wherein only one of the front face or back face of each cell structure intersects a vertical axis located at one-half the width of the juncture lines at a top juncture line of each cell structure and wherein only the other of the front face or back face intersects the vertical axis at a bottom juncture line of each cell structure.

8. A cellular shade as defined in claim 7, wherein only the back face of each cell structure intersects the vertical axis at the top juncture line and wherein only the front face intersects the vertical axis at the bottom juncture line of each cell structure.

9. A cellular shade as defined in claim 1, wherein, when the shade is in a fully retracted configuration, the plurality of closed cell structures hang in a vertical and adjacently disposed orientation whereby upper edges of the collapsed closed cell structures are adjacent and oriented in an upward vertical direction and bottom edges of the collapsed closed cell structures are adjacent and oriented in a downward vertical direction.

10. A cellular shade as defined in claim 9, wherein the collapsed closed cell structures fold along the first fold lines that define the bottom edges and fold along the second fold lines that define the upper edges.

11. A cellular shade as defined in claim 9, wherein the first and second segments of the back faces comprise two separate pieces of material joined together along the second fold lines and wherein tabs are formed where the two pieces of material are joined together, the tabs extending traversely from the closed cell structures at about mid-height of the closed cell structures, the lift system comprising a plurality of lift cords that are attached to the tabs for placing the shade in the fully retracted configuration.

12. A cellular shade as defined in claim 1, wherein the front faces are made from a different material than the back face.

13. A cellular shade as defined in claim 12, wherein the back faces have a transmittance at a wavelength of 500 nanometers that is at least 50% greater than a transmittance of the front faces at 500 nanometers.

14. A cellular shade as defined in claim 12, wherein the back faces have a light transmittance at a wavelength of 500 nanometers of at least 40%.

15. A cellular shade comprising:

a plurality of sequential and interconnected closed cell structures extending in a longitudinal direction, the cell structures having a collapsed position when the shade is retracted and having an open position when the shade is extended, at least some of the cell structures including a front face and a separate back face, the front face including a first segment separated from a second segment by a first fold line, the back face including a corresponding first segment separated from a corresponding second segment by a second fold line, wherein the first segment of the front face has a length less than the length of the second segment of the front face, wherein the first segment of the back face has a length greater than the length of the second segment of the back face, and wherein the first segment of the front face is above the second segment of the front face in the longitudinal direction and the first segment of the back face is above the second segment of the back face in the longitudinal direction;

wherein the front face of a higher cell is attached to both the front face and the back face of a lower adjacent cell and the back face of the higher cell is attached to the back face of the lower adjacent cell;

wherein the second segment of the front face of the higher cell structure overlaps with both the front face and the back face of the lower cell structure, and wherein the second segment of the back face of the higher cell structure overlaps with only the back face of the lower cell structure; and a lift system configured for vertically drawing said cell structures from an expanded configuration into a contracted configuration.

16. A cellular shade as defined in claim 15, wherein the cellular shade includes a plurality of juncture lines that attach adjacent cell structures together, the juncture lines having a width extending from a front to a back of the cell structures and wherein only one of the front face or back face of each cell structure intersects a vertical axis located at one-half the width of the juncture lines at a top juncture line of each cell structure and wherein only the other of the front face or back face intersects the vertical axis at a bottom juncture line of each cell structure.

17. A cellular shade as defined in claim 16, wherein only the back face of each cell structure intersects the vertical axis at the top juncture line and wherein only the front face intersects the vertical axis at the bottom juncture line of each cell structure.

18. A cellular shade comprising:

a plurality of sequential and interconnected closed cell structures extending in a longitudinal direction, the cell structures having a collapsed position when the shade is retracted and having an open position when the shade is extended, at least some of the cell structures including a front face and a separate back face, the front face including a first segment separated from a second segment by a first fold line, the back face including a corresponding first segment separated from a corresponding second segment by a second fold line, and wherein the first segment of the front face has a length less than the length of the second segment of the front face and wherein the first segment of the back face has a length greater than the length of the second. segment of the back face;

a lift system configured for vertically drawing said cell structures from an expanded configuration into a contracted configuration;

a plurality of juncture lines that attach adjacent cell structures together, the juncture lines having a width extending from a front to a back of the cell structures and wherein only the back face of each cell structure intersects a vertical axis located at one-half the width of the juncture lines at a top juncture line of each cell structure and wherein only the front face of each cell structure intersects the vertical axis at the bottom juncture line of each cell structure; and wherein the second segment of the front face of the higher cell structure overlaps with both the front face and the back face of the lower cell structure, and wherein the second segment of the back face of the higher cell structure overlaps with only the back face of the lower cell structure.

19. A cellular shade as defined in claim 18, wherein the back face of each cell structure is attached to the back face of each adjacent cell structure and wherein the front face of each cell structure is attached to the front face of each adjacent cell structure.

* * * * *